US006077103A

United States Patent [19]

Saka et al.

[11] Patent Number: 6,077,103

[45] Date of Patent: Jun. 20, 2000

[54] CRAMPING TERMINAL

[75] Inventors: Yukinori Saka; Masamitsu Chishima; Satomi Seko, all of Yokkaichi, Japan

[73] Assignee: Sumitomo Wiring Systems, Ltd., Japan

[21] Appl. No.: 09/244,520

[22] Filed: Feb. 4, 1999

[30] Foreign Application Priority Data

Feb. 9, 1998 [JP] Japan ..... 10-027603

[51] Int. Cl.[7] ..... H01R 11/20

[52] U.S. Cl. ..... 439/397

[58] Field of Search ..... 439/397

[56] References Cited

U.S. PATENT DOCUMENTS 3,162,501 12/1964 Wahl ..... 439/397
3,993,391 11/1976 Vernerey et al. ..... 439/397

FOREIGN PATENT DOCUMENTS 62-193067 8/1987 Japan .
10-12291 1/1998 Japan .
2028600 3/1980 United Kingdom .

*Primary Examiner*—Gary F. Paumen
*Assistant Examiner*—Briggitte Hammond
*Attorney, Agent, or Firm*—Anthony J. Casella; Gerald E. Hespos; Michael J. Porco

[57] ABSTRACT

A cramping terminal is provided to have a strong groove portion and an electrical connection with an improved reliability. The cramping terminal 20 has a side cramping blade 29 provided in a groove portion 25. The side cramping blade 29 is formed by bending projections 40 that define the side cramping blade 29 in different directions. Accordingly, holes 42 formed by the projections 40 are left in one side wall 27 more toward one end of the groove portion 25 than the side cramping blade 29 and in the other side wall more toward the other end of the groove portion 25 than the side cramping blade 29. Therefore, the side walls 27 remain opposite to the hole 42, enhancing the strength of the groove portion 25.

6 Claims, 6 Drawing Sheets

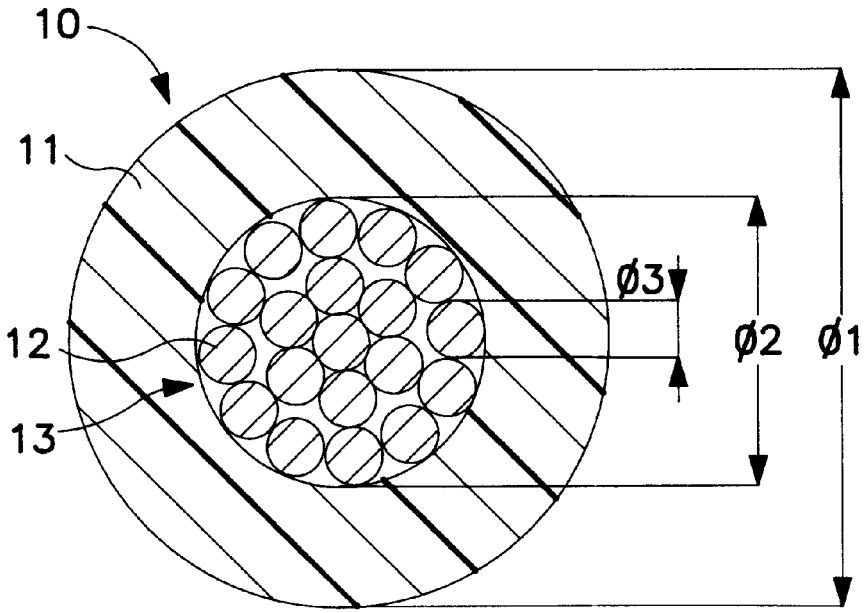
FIG. IA
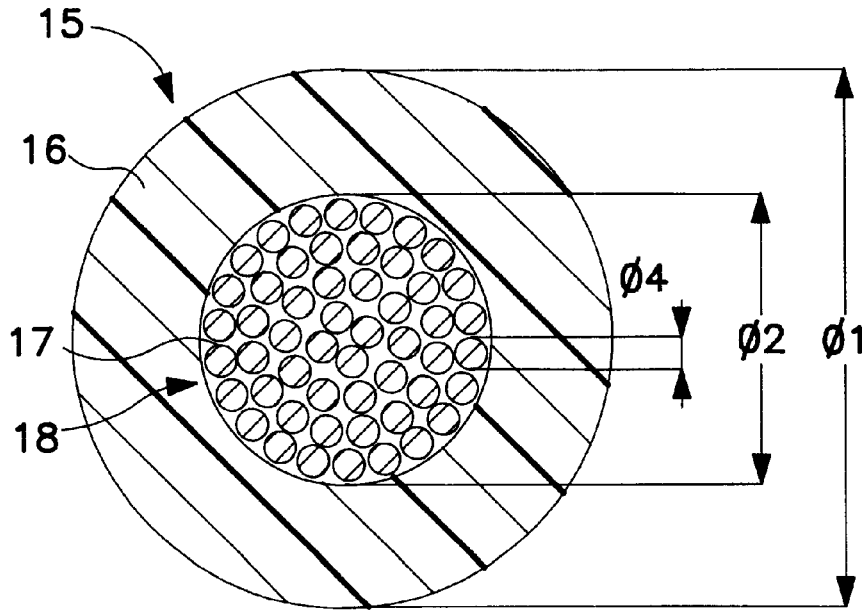
FIG. IB

CRAMPING TERMINAL

BACKGROUND OF THE INVENTION

1. Field of the Invention

The present invention relates to a cramping terminal.

2. Description of the Related Art

A prior art cramping terminal has a substantially U-shaped groove portion which typically is formed by bending a metal plate. A cramping blade is disposed in the groove portion and is formed with a slit. The blade is configured to cut an insulation coating of a wire pushed into the slit, thereby bringing a core of the wire into contact with the inner surface of the slit to establish an electrical connection.

There are two types of prior art cramping blades. In particular, a prior art U-slot cramping blade 5 is shown in FIG. 7, and is made by forming a slit 4 in an upright piece 3 that had been formed by cutting and bending a portion of a bottom wall 2 of a U-shaped groove portion 1. The prior art also includes a side cramping blade 8 as shown in FIG. 8. The side cramping blade 8 is formed by cutting and bending portions of opposite side walls 6 of a groove portion 1 in such a manner as to face each other. With the prior art side cramping blade 8, a pair of holes 7A are formed in the opposite side walls 6 in the same position along the longitudinal direction of the groove portion 1, thereby causing a reduction in the strength.

There also is a demand for adding a side cramping blade to a known cramping terminal 9 with a pair of U-slot cramping blades 5, as shown in FIG. 9, in an effort to improve the reliability of an electrical connection with a wire. In such a case, a side cramping blade 8 has been formed in the cramping terminal 9 as shown in FIG. 10. However, with this prior art design, a hole 9B left in the bottom wall 2 by forming the U-slot cramping blade 8 and the holes 7A of the opposite side walls 6 are in the same position with respect to the longitudinal direction of the groove portion 1. This design, therefore, leaves only a small area of walls, as indicated by the hatched portions in FIG. 11, and hence weakens the connector.

In view of the above problems, an object of the present invention is to provide a cramping terminal which has a groove portion of a higher strength and ensures a more reliable electrical connection.

SUMMARY OF THE INVENTION

According to the invention, there is provided a cramping terminal, comprising at least one cramping portion provided in or at a groove portion. The cramping portion is configured to cut an insulation coating and to electrically connect with a core of a wire when the wire is at least partially pushed into the groove portion. The cramping portion comprises at least one side cramping blade formed by cutting and bending portions of substantially opposite side walls of the groove portion to define projections. The projections are cut and bent such that their leading ends face substantially opposite to each other. A substantially C-shaped notch is made in one side wall to form one projection of the side cramping blade and a substantially C-shaped notch is made in the other side wall to form the other projection, the projections are cut and bent from the respective side walls in substantially opposite bending directions. Thus, according to a preferred embodiment of the invention, the projections are oriented in substantially opposite projection directions.

Holes formed in the side walls by bending the projections preferably are displaced with respect to each other in a longitudinal direction of the cramping connector. Accordingly, the strength of the cramping terminal can be enhanced, since the material thereof is not weakened in the same or similar longitudinal positions.

Preferably, engaging corners of the projections are rounded.

Most preferably, the groove portion is formed by bending a metal plate to have a substantially U-shaped cross section.

According to a further preferred embodiment, there is provided a cramping terminal, comprising a cramping portion provided in a groove portion formed by bending a metal plate to have a substantially U-shaped cross section. The cramping portion is configured to cut an insulation coating and to be electrically connected with a core of a wire when the wire is pushed into the groove portion. The cramping portion comprises a side cramping blade formed by leading ends of a pair of projections that have been cut and bent from opposite side walls of the groove portion, such that the leading ends face opposite to each other. A C-shaped notch is made in one side wall to form one projection of the side cramping blade and a C-shaped notch is made in the other side wall to form the other projection. The notches are oriented in opposite directions. Thus one projection is bent from a first end of the groove portion toward a second end thereof, while the other projection being bent from the second end of the groove portion toward the first end thereof.

Holes are left in the side walls when the projections are bent to form the side cramping blade. Since the projections of the side cramping blade are bent in different directions, the holes left by forming the projections are or may be located in the one side wall more toward the first end of the groove portion than the side cramping blade and in the other side wall more toward the second end of the groove portion than the side cramping blade. Thus, the holes are displaced longitudinally with respect to each other, and the side walls remain substantially opposite to the holes for enhancing the strength of the groove portion.

Preferably, the cramping portion comprises at least one pair of substantially U-slot cramping blades each formed by making a slit substantially in the middle of an upright piece formed by cutting and bending a portion of the bottom wall of the groove portion, and the side cramping blade. Accordingly, since the pair of U-slot cramping blades and the side cramping blade are provided in the groove portion, thereby increasing contact portions with the wire, the reliability of the connection can be improved.

Most preferably, the upright piece is arranged at an angle different from 0° or 180°, preferably substantially normal to the bottom wall.

These and other objects, features and advantages of the present invention will become more apparent upon a reading of the following detailed description and accompanying drawings.

BRIEF DESCRIPTION OF THE DRAWINGS

FIG. 1(A) is a section of a usual wire, and FIG. 1(B) is a section of a flexible wire.

DETAILED DESCRIPTION OF THE PREFERRED EMBODIMENT

Figure 2:
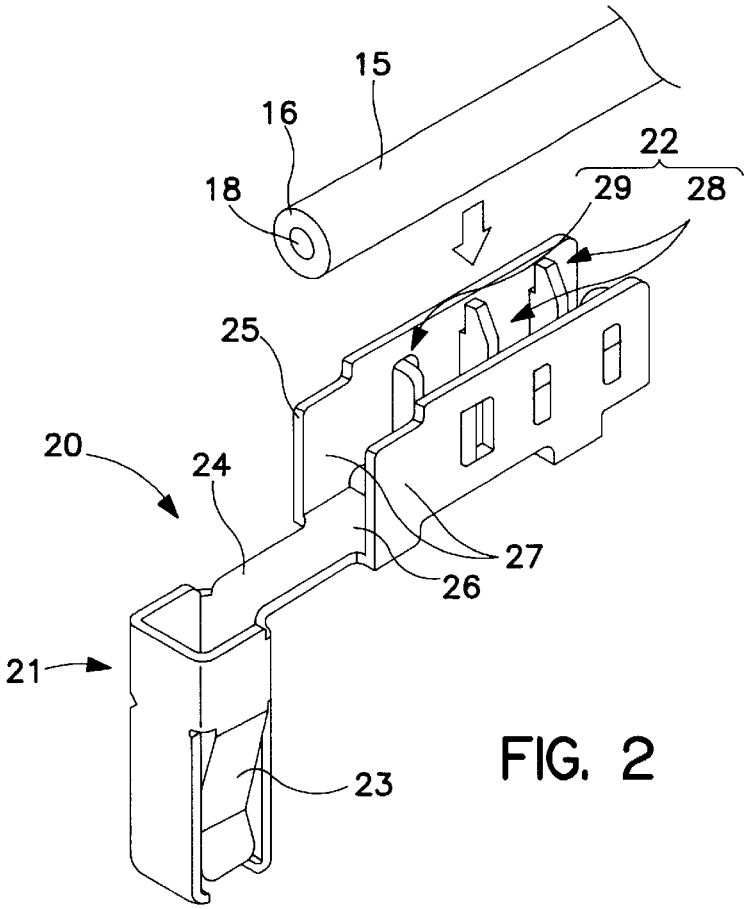
FIG. 2 is a perspective view of a cramping terminal according to one embodiment of the invention.

A cramping terminal according to an embodiment of the invention is designed for use with a usual wire 10 (see FIG. 1(A)) and also a so-called flexible wire 15 (see FIG. 1(B)). The usual wire 10 has a core 13 made of a plurality of strands 12 inside an insulation coating 11. The flexible wire 15 has an insulation coating 16 and a core 18 having the same outer diameters $\phi 1$, $\phi 2$ as those of the usual wire 10, but has more strands 17 because the strands 17 are thinner than those of the usual wire 10. In other words, the outer diameter $\phi 4$ of the strands 17 of the flexible wire 15 is smaller than the outer diameter $\phi 3$ of the strands 12 of the usual wire 10. By using the thinner strands, the flexible wire 15 has an advantage that bendability is better than the usual wire 15 and a disadvantage that no large force cannot be exerted on the strands 17 while the flexible wire 15 is being connected. The cramping terminal described below has a construction for compensating for this disadvantage.

Figure 3:
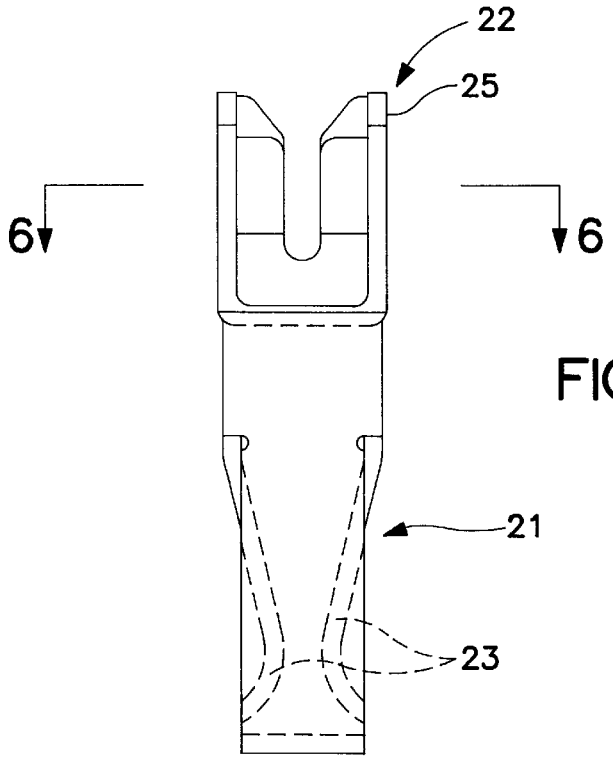
FIG. 3 is a front view of the cramping terminal.

A cramping terminal in accordance with the subject invention is identified by the numeral 20 in FIG. 2. The cramping terminal 20 is so formed as to substantially have an L-shape as shown in FIG. 2 by successively cutting and bending a conductive metal plate. A portion vertically extending in FIG. 2 acts as a tab connection portion 21 with an unillustrated mating terminal. The tab connection portion 21 is substantially in the form of a rectangular tube, and four walls of this rectangular tube extend from an intermediate position to the bottom end in the form of strips. A pair of opposite strip portions 23 are bent substantially closer (or to be convergent) to each other (see FIG. 3) so as to tightly hold a tab of the unillustrated mating terminal that is at least partially insertable therebetween.

The cramping terminal 20 also is provided with a groove portion 25 having preferably a substantially U-shaped cross section at the leading end of a flat portion 24 extending from one side at the upper end of the rectangular tube of the tab connection portion 21. A cramping portion 22 comprised of substantially U-shaped slot cramping blades 28 and a side cramping blade 29 is provided in or at the groove portion 25.

Figure 4:
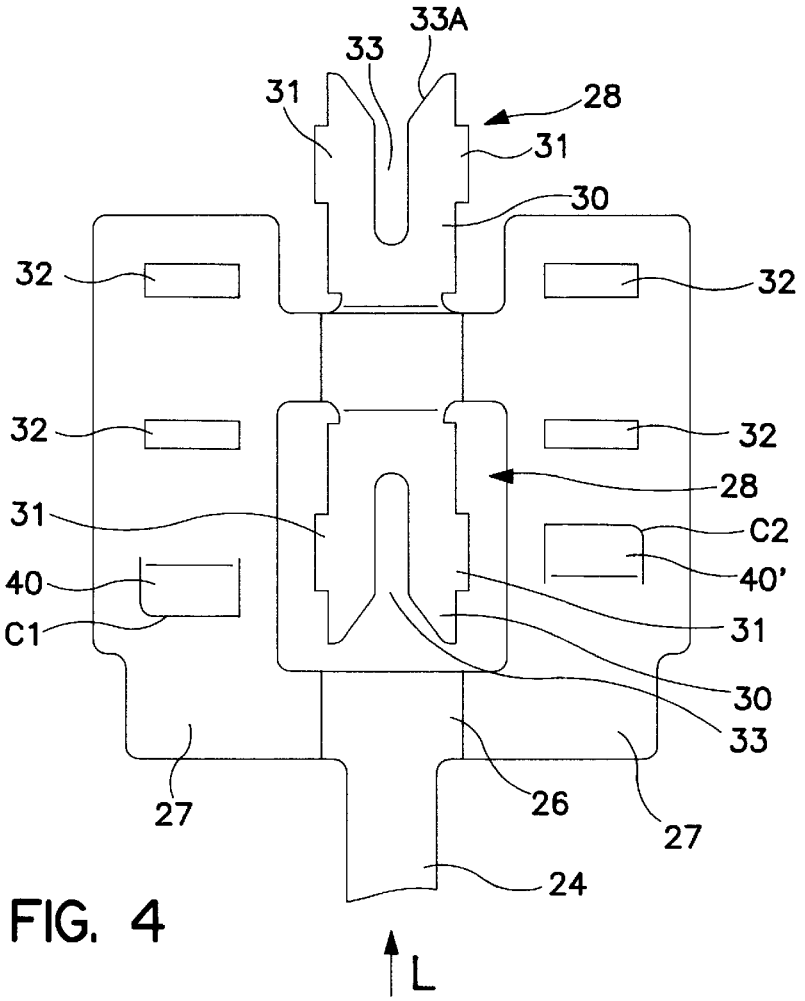
FIG. 4 is a development of a groove portion.

The groove portion 25 is constructed such that a pair of side walls 27 are bent at an angle different from 0° or 180°, preferably at substantially right angles at the opposite sides of a bottom wall 26 which extends substantially flush with or adjacent to the flat portion 24. The pair of U-slot cramping blades 28 preferably are provided at a side of the groove portion 25 substantially away from the flat portion 24. These blades 28 are formed as follows. A pair of substantially upright pieces 30 extending in substantially opposite directions along the longitudinal direction L of the groove portion 25 are formed by punching portions of a metal plate of the groove portion 25 in its developed state shown in FIG. 4. The upright pieces 30 then are bent at an angle different from 0° or 180°, preferably substantially at right angles to face each other. Locking portions 31 project from substantially opposite side edges of each upright piece 30. The respective locking portions 31 are engaged or engageable with lock holes 32 formed in the opposite side walls 27 so as to hold the cramping blade 28 standing or in a position or orientation at an angle different from 0° or 180°, preferably substantially normal with respect to the bottom wall 26 (see FIG. 5). A slit 33 is formed in the free end of each upright portion 30. The slit 33 is open at its free end and is substantially in the middle of each upright portion 30 with respect to its widthwise direction. The flexible wire 15 is guided into the slit 33 by tapered portions 33A formed at the open side of the slit 33. The width of the slit 33 is slightly narrower than the diameter $\phi 2$ (see FIG. 1(B)) of the core 18 of the flexible wire 15. The core 18 of the flexible wire 15 is or can be pushed at least partially into the slit 33 to achieve electrical connection. The slit 33 preferably is slightly wider than a slit of a cramping blade used to cramp the usual wire 10, so that no large force acts on the strands 17 when the flexible wire 15 is pushed into the slit 33.

Figure 5:
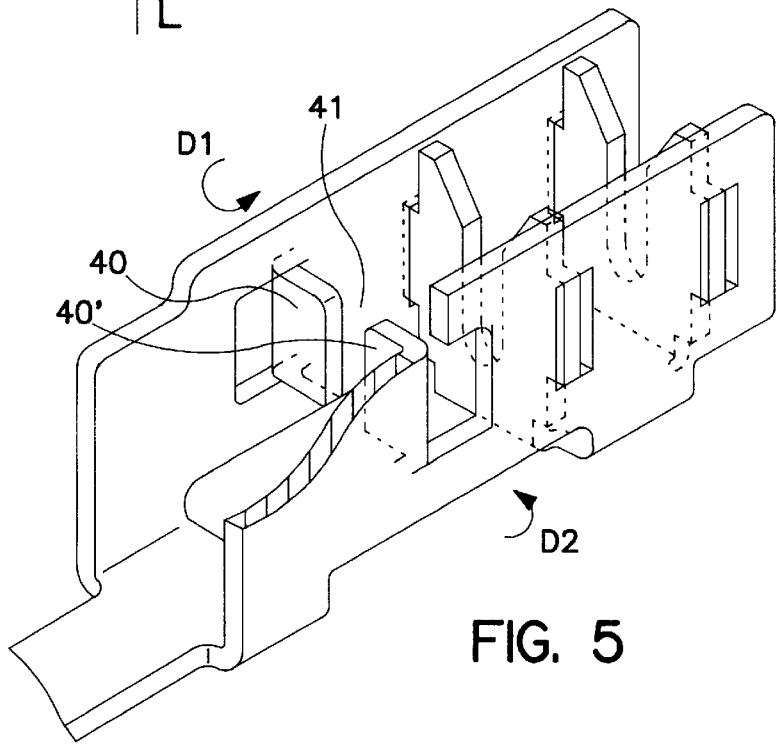
FIG. 5 is an enlarged perspective view of the groove portion.
Figure 6:
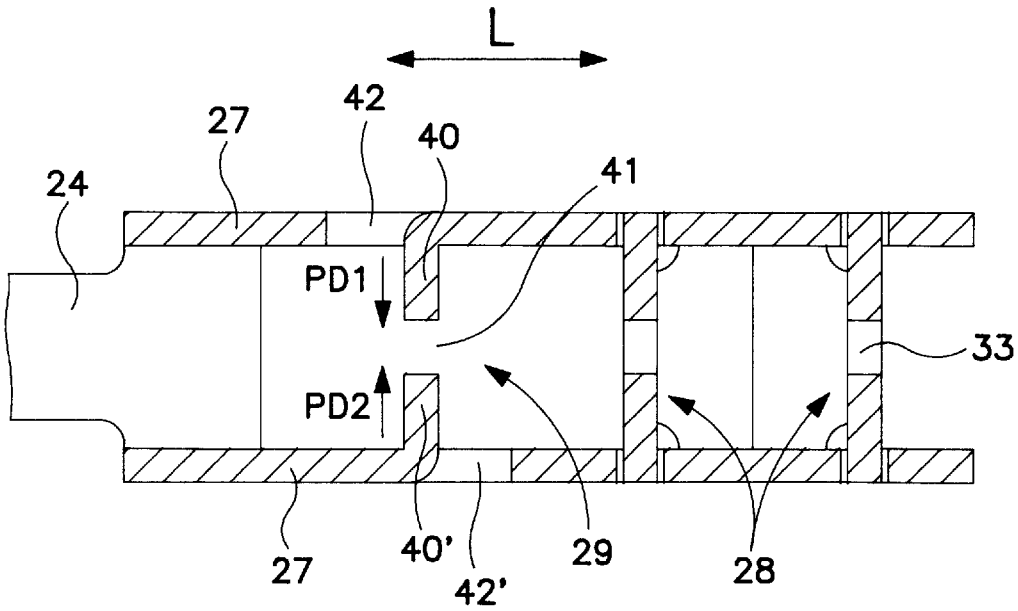
FIG. 6 is a section along 6—6 of FIG. 3.

As shown in FIG. 6, the side cramping blade 29 is formed at a portion of the groove portion 25 in vicinity of or adjacent to the flat portion 24. The blade 29 is formed by causing the leading ends of a pair of portions or projections 40, 40' cut and bent or folded or twisted from the opposite side walls 27 of the groove portion 25 to substantially face each other at a slit 41. The first or upper one 40 of the projections 40, 40' in FIG. 6 is formed by making a substantially C-shaped notch C1 (see FIG. 4) in one side wall 27 and bending a portion inside the notch C1 in a direction D1 substantially away from the portion of the groove portion 25 near the flat portion 24. The second or lower projection 40' in FIG. 6 is formed by forming a substantially inverted C-shaped notch C2 (see FIG. 4) in the other side wall 27 and bending a portion inside the notch C2 in a direction D2 substantially toward the portion of the groove portion 25 near the flat portion 24. In other words, the bending directions D1 and D2 of the projections 40, 40' are substantially opposed or rotationally inverted (e.g. D1 being in counterclockwise direction and D2 being in clockwise direction in FIG. 5). Accordingly, the projections 40, 40' cannot be bent easily in one same direction by a force acting on the wire 15 inserted therebetween, since the different or opposed bending directions D1, D2 cause different bending properties of the projections 40, 40' when subjected to a force in a substantially same direction. Holes 42, 42' (see FIG. 6) left in the side walls 27 by forming the projections 40, 40' are displaced from each other with respect to the longitudinal direction L of the groove portion 25 or of the lateral side walls 27 (transverse direction in FIG. 6). Further, the slit 41 of the side cramping blades 29 has the same width as the slits 33 of the U-slot cramping blades 28. The upper or engaging corners (or corners first coming into contact with the wire 15) of the projections 40, 40' are rounded or slanted or tapered as shown in FIG. 5 in order to guide the flexible wire 15 into the slit 41.

Figure 9:
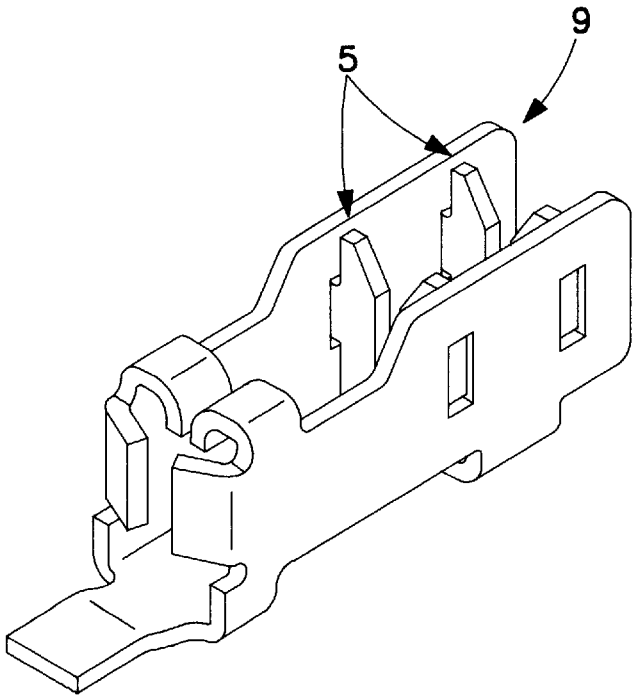
FIG. 9 PRIOR ART
FIG. 9 is an enlarged partial perspective view of a groove portion of a prior art cramping terminal.
Figure 7:
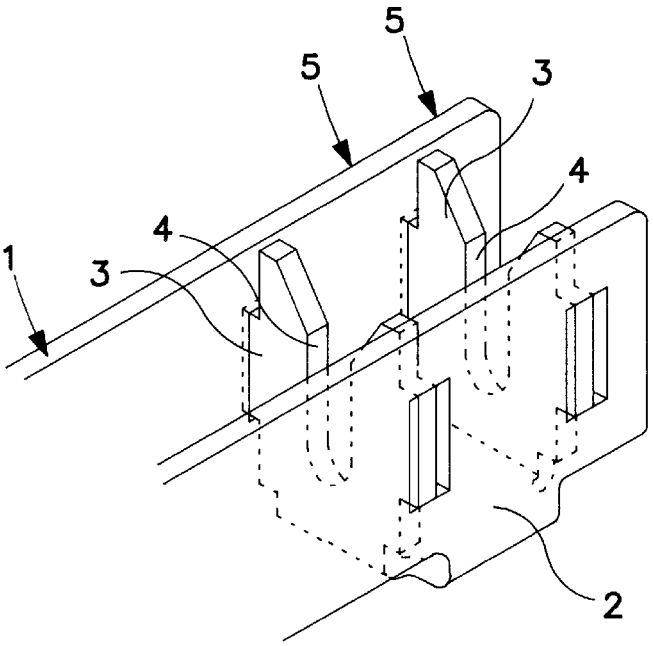
FIG. 7 PRIOR ART
FIG. 7 is a perspective view of U-slot cramping terminals.
Figure 8:
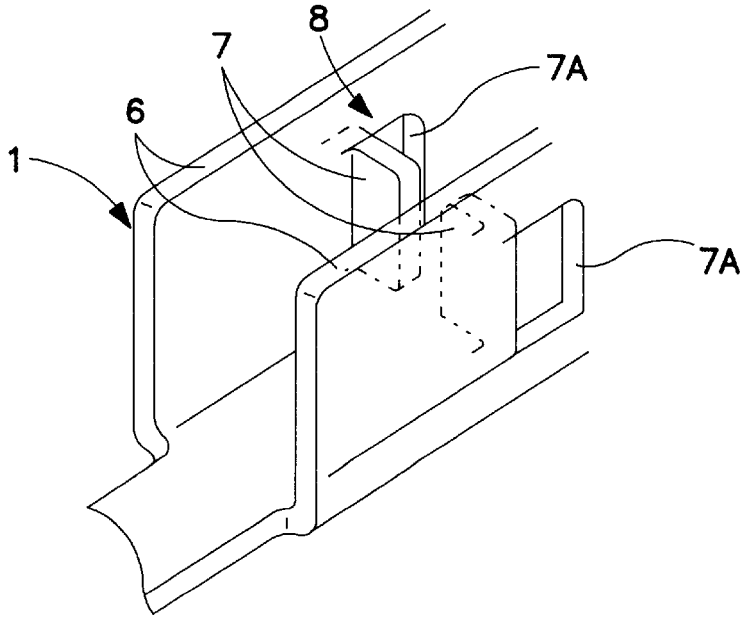
FIG. 8 PRIOR ART
FIG. 8 is a perspective view of a side cramping terminal.
Figure 10:
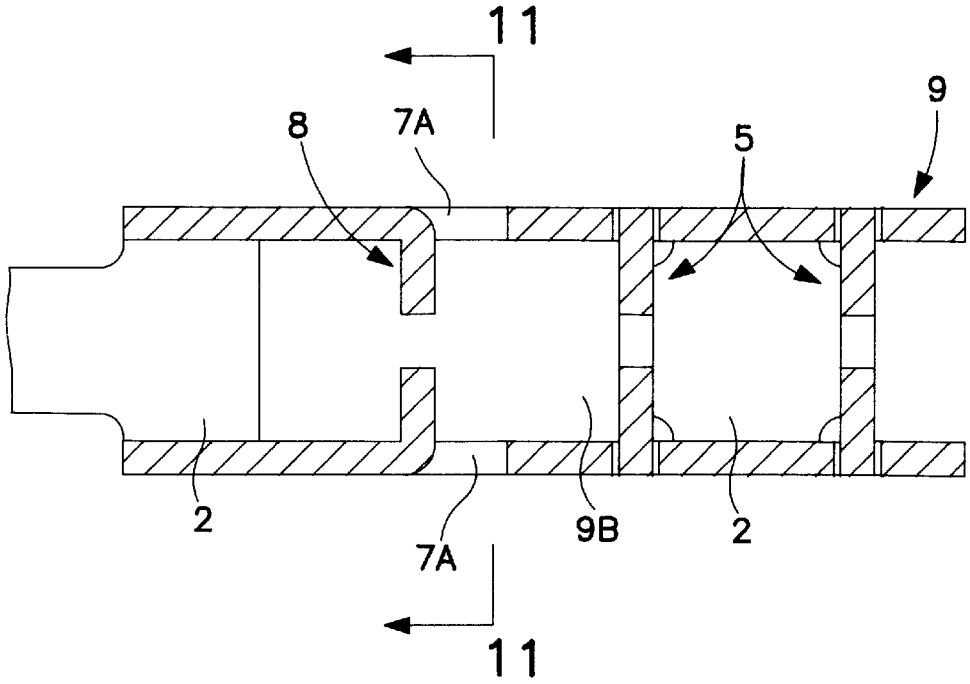
FIG. 10 PRIOR ART
FIG. 10 is a section of the prior art cramping terminal additionally provided with a side cramping blade.
Figure 11:
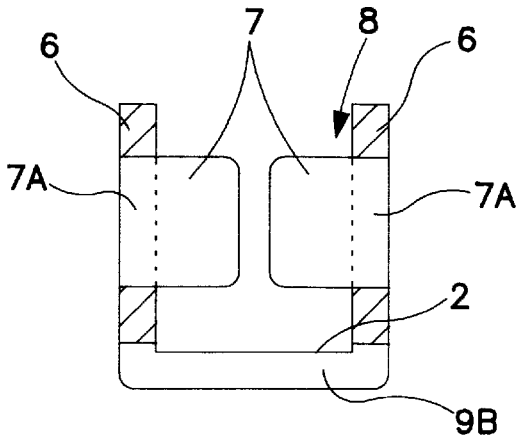
FIG. 11 PRIOR ART
FIG. 11 is a section along 11—11 of FIG. 10.

To connect the flexible wire 15 with the cramping terminal 20 according to this embodiment, the flexible wire 15 is at least partially inserted in or pushed substantially to the bottom of the groove portion 25 through an opening in the lateral or upper surface (or insertion side) of the groove portion 25 of the cramping terminal 20, for example, with the cramping terminal 20 accommodated in an unillustrated housing. Then, the flexible wire 15 is substantially pressed into the slits 33, 41 in the cramping blades 28, 29 with the insulation coating 16 thereof cut in by the edges of the slits 33, 41, and the core 18 is brought substantially into contact with the inner surfaces of the slits 33, 41. The flexible wire 15 and the cramping terminal 20 are connected electrically in at least three positions where the cramping blades 28, 29 are provided. In the cramping terminal 20 of this embodiment, there are more contact portions than in the cramping terminal (see FIG. 9) provided with two cramping terminals for the usual wire 10. Thus, the reliability of the electrical connection can be improved.

There are some cases where a force acts on the cramping terminal 20 during the assembling of the cramping terminal 20 into the housing, the cramping operation, etc. Since the projections 40, 40' of the side cramping blade 29 are bent in different or opposed directions D1, D2 in the cramping terminal 20 of this embodiment, the hole 42 left in the one side wall 27 by forming the projection 40 is located more toward one end of the groove portion 25 than the cramping blade 29 and the hole 42' left in the other side wall 27 by forming the projection 40' is located more toward the other end of the groove portion 25 than the cramping blade 29. Thus, as shown in FIG. 6, the holes 42, 42' are not substantially opposed and the side walls 27 remain substantially opposite to the respective holes 42, 42', which enhances the strength of the groove portion 25. In other words, the holes 42, 42' are substantially displaced or positioned at a distance in or along a longitudinal direction L (FIG. 6) of the side walls 27 or of the cramping terminal 20. According to the cramping terminal 20 of this embodiment, the strength of the groove portion 25 can be enhanced while the reliability of the electrical connection with the flexible wire 15 can be improved.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

Although the side cramping blade 29 is provided more toward one end of the groove portion 25 than the U-slot cramping blades 28 in the foregoing embodiment, it may be provided between the U-slot cramping blades 28.

Although the flexible wire 15 is connected with the cramping terminal 20 in the foregoing embodiment, the latter may be connected with the usual wire 10.

Even though only two U-shaped slot cramping blades 28 are provided in the above embodiment, only one or three or more may be provided as needed.

What is claimed is:

1. A cramping terminal, comprising:

a groove portion formed by bending a metal plate to have a bottom wall and opposed first and second side walls extending from the bottom wall such that said groove portion has opposed front and rear ends and a substantially U-shaped cross section extending between the front and rear ends, a cramping portion provided at a selected location between the front and rear ends of the groove portion, the cramping portion having a slit dimensioned for cutting an insulation coating and electrically connecting with a core of a wire when the wire is at least partially pushed into the groove portion, wherein the cramping portion comprises a first side cramping blade formed by cutting a portion of the first side wall between the selected location and the front end of the groove portion and bending the cut portion of the first side wall of the groove portion rearwardly to define a hole between the selected location and the front end of the groove portion, the cramping portion further comprising a second side cramping blade formed by cutting a portion of the second side wall between the selected location and the rear end of the groove portion and bending the cut portion of the second side wall of the groove portion forwardly to define a hole between the selected location and the rear end of the groove portion, the first and second side cramping blades defining projections having ends that face each other, whereby the holes in the first and second side walls are offset on opposite respective sides of the selected location in the groove portion to enhance strength for the groove portion.

2. The cramping terminal of claim 1, wherein engaging corners of the projections are tapered.

3. The cramping terminal of claim 1, wherein the side walls are substantially parallel to one another, and wherein the first and second side cramping blades are substantially normal to the side walls.

4. The cramping terminal of claim 1, wherein the cramping portion further comprises at least one pair of U-slot cramping blades each being formed by making a slit in substantially centrally in an upright piece formed by cutting and bending a portion of the bottom wall of the groove portion.

5. The cramping terminal of claim 4, wherein the upright piece is substantially normal to the bottom wall.

6. The cramping terminal of claim 4, wherein the U-slot cramping blades each are disposed between the selected location and the rear end of the groove portion.

* * * * *